United States Patent [19]

Kobayashi et al.

[11] 3,957,111

[45] May 18, 1976

[54] APPARATUS FOR COOLING SOLIDS OF HIGH TEMPERATURE

[75] Inventors: Toshiji Kobayashi; Yutaka Takahashi, both of Kobe, Japan

[73] Assignee: Kawasaki Jukogyo Kabushiki Kaisha, Kobe, Japan

[22] Filed: Nov. 30, 1973

[21] Appl. No.: 420,500

[30] Foreign Application Priority Data

Nov. 30, 1972 Japan ..... 47-120487

[52] U.S. Cl. ..... 165/96; 62/383; 62/430; 62/436; 62/512; 266/251; 266/259; 432/77

[51] Int. Cl.² ..... F28F 27/00; C21B 7/10; C21D 1/74

[58] Field of Search ..... 432/77, 85, 234, 198; 266/5 H, 32 X; 165/53, 49, 96, 120; 62/430, 436, 388, 383, 512, 514; 137/209, 210; 34/79; 65/348, 288; 164/66, 259, 297, 348, 126, 128

[56] References Cited

UNITED STATES PATENTS

| | | | |
|---|---|---|---|
| 2,805,851 | 9/1957 | Becker et al. | 266/32 |
| 2,840,995 | 7/1958 | Hazard | 62/388 X |
| 2,855,193 | 10/1958 | Gilbert | 432/198 X |
| 2,907,082 | 10/1959 | Pond | 164/66 |
| 2,971,350 | 2/1961 | Mills | 62/272 |
| 3,019,618 | 2/1962 | Meyer | 165/120 X |
| 3,048,375 | 8/1962 | Walker | 165/49 |
| 3,120,240 | 2/1964 | Kreuter | 137/210 |
| 3,182,981 | 5/1965 | Walker | 432/198 X |
| 3,279,774 | 10/1966 | Biro | 266/5 H X |
| 3,416,547 | 12/1968 | Glenn, Jr. et al. | 137/210 X |
| 3,512,573 | 5/1970 | Herff | 164/66 X |
| 3,748,866 | 7/1973 | Heider et al. | 62/430 X |
| 3,824,066 | 7/1974 | Muranyi et al. | 432/198 X |

*Primary Examiner*—Albert W. Davis, Jr.
*Assistant Examiner*—Sheldon Richter
*Attorney, Agent, or Firm*—Sughrue, Rothwell, Mion, Zinn & Macpeak

[57] ABSTRACT

A metal cooling wall surrounds a conveyor carrying solids such as steel slabs at high temperature through the chamber defined by the cooling wall and the wall receives heat from the slabs by radiation. A liquid such as water flowing under pressure within passages within the cooling wall removes heat from the cooling wall with the control of coolant temperature controlling the cooling speed of the solids. A gas such as water vapor or carbon dioxide gas having the absorbing ability of the radiation fills the space between the slabs and the cooling wall to further control the cooling speed of the steel billets.

6 Claims, 2 Drawing Figures

FIG. 1
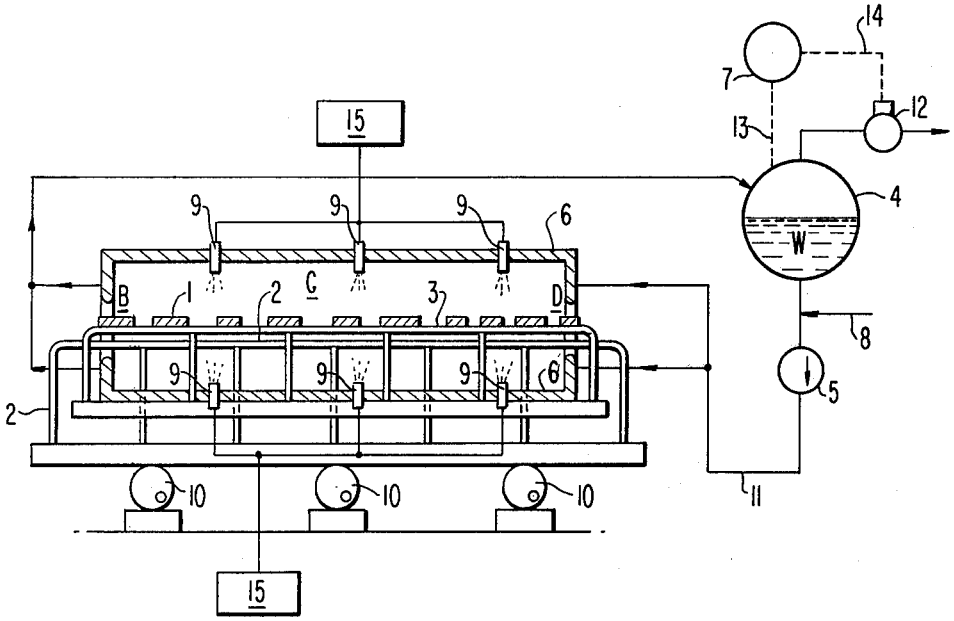
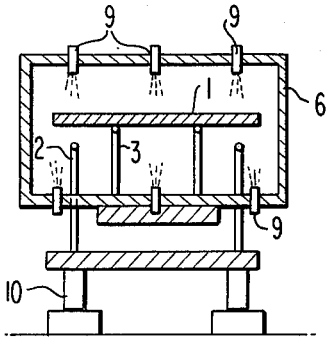
FIG. 2

APPARATUS FOR COOLING SOLIDS OF HIGH TEMPERATURE

BACKGROUND OF THE INVENTION

1. Field of the Invention

This invention relates to apparatus for cooling solid materials of high temperature, and more particularly, to an apparatus for cooling solids such as steel slabs.

2. Description of the Prior Art

During the production of steel within an ironworks, the material is treated through multiple heating and cooling steps. The method of cooling steel varies depending upon the type of steel being processed. For instance, steel material in slab form or the like, as processed by a blooming mill, and having heat of about 1000° C. and sent to a cooling yard and cooled down to about 100° C. prior to being sent to the next processing stage, is cooled by cooling processes which fall into three categories. Slow cooling is required for alloy steel and high carbon steels. Air cooling is required for middle carbon steels, and water cooling at high speed is required for low carbon steels.

The reason why alloy steels and high carbon steels may not be water cooled is because:

a. By water-cooling, the steel is hardened and becomes liable to be cracked during the cooling by the transformation stress, and accordingly, it is difficult to treat the surface after water-cooling.

b. Small internal defects called white spots are produced.

c. The formation of cracks is accelerated by the thermal stress caused by the temperature difference between the surface and the interior of the steel body being processed, and the thicker the material, the more sensitive the steel is to the formation of cracks.

The object of the present invention is to provide an apparatus for the cooling of solid material at high temperature, such as high carbon steel members.

SUMMARY OF THE INVENTION

In general, the invention is directed to a wall surrounding the solids of high temperature to be cooled and spaced from the solids and receiving by radiation heat from the solids, wherein the improvement comprises the flowing of a coolant liquid in contact with the walls to remove the heat from the cooling wall. The coolant temperature may be varied to control the cooling rate of the wall with respect to the high temperature solids which radiate the heat to the wall. The space between the solid and the cooling wall may be filled with a gas capable of heat absorption to in turn control the amount of radiation of heat from the solid to the wall. Preferably, the gas may be either water vapor or carbon dioxide gas.

BRIEF DESCRIPTION OF THE DRAWINGS

FIG. 1 is a partial schematic, partial sectional view of the cooling apparatus of the present invention as applied to cooling high temperature pieces of steel.

FIG. 2 is a sectional view of the apparatus of FIG. 1.

DESCRIPTION OF THE PREFERRED EMBODIMENT

Turning to the drawings, one form of the apparatus for cooling high temperature solids such as steel pieces of the present invention, is so illustrated although the objects being cooled are not limited to steel members but may be any metal or non-metal solid material, at high temperature.

In the illustrated embodiment of the invention, steel members 1 of high temperature are fed through inlet B of the cooling apparatus as defined by cooling wall 6 forming an elongated cooling chamber C to outlet D where the steel members are removed after being cooled down to a predetermined temperature. The transportation of steel members 1 and the support thereof during cooling are performed by working beams 2 operated by drive unit 10 and stationary beams 3, respectively.

In order to effect cooling, cooling water W which accumulates within steam separator 4 is delivered to passages (not shown) within cooling wall 6 by pump 5, as indicated by the direction of arrow, through a suitable conduit means 11, where the water W absorbs the radiation heat from the surface of the steel members which are received by wall 6, and a part of the water is vaporized and returns to the steam separator 4 in closed loop fashion by the employment of the conduit means 11. The return of the coolant to the steam separator is in the form of a gas-water mixture. The vapor portion of the gas-water mixture is taken out and the cooling water W is available to repeat a circulation path under pressure by pump 5 through the wall passages. The cooling wall 6 may have a water cooling wall construction of conventional form in which steel pipes (not shown) are arranged in side by side relationship and extend longitudinally of the apparatus. The temperature of the cooling wall surface becomes substantially equal to the temperature of the cooling water flowing through the wall, since the thermal transmission coefficient of the cooling water is extremely large in comparison with the thermal energy transmission coefficient of the radiation heat. Since the cooling water is in saturated condition, it is possible to raise and lower the saturation temperature by a use of a pressure controlling device 7 which maintains the pressure within the vapor separator 4. That is to say, in case the cooling speed for the steel member needs to be raised, the cooling water temperature is lowered by lowering the pressure within the vapor separator 4 by lowering the pressure setting of the pressure controlling device 7, that is, the pressure control device 7 permits the valve to open at a lower pressure within the separator 4. In this respect, line 13 detects the pressure within the separator 4 to be measured by the controlling device 7 which, in turn, controls the operation of valve 12 through electrical or pneumatical connection 14. Further, to increase the cooling speed of the steel pieces 1, it is possible to add additional cooling water to the closed loop circulation via conduit 11, cooling water being added from cooling water supply 8 located between separator 4 and pump 5. When a slower cooling speed is desired, the pressure setting for the vapor separator 4 is raised and the rise in saturation temperature may be measured.

The temperature of the cooling water can theoretically be set to any temperature from room temperature to the critical pressure saturation temperature of 374° C. However, the cooling apparatus is required to subject to high pressure and becomes very costly in order to carry out cooling at relatively high temperatures approaching the critical saturation temperature.

In order to lower the cooling speed with a comparatively low pressure construction of the system, a plurality of vapor blowing nozzles 9 may be provided which are coupled to a source of vapor as at 15, which vapor is capable of absorbing the heat of radiation, the vapor being injected into the cooling chamber C under pressure by the nozzles shown schematically at 9. The vapor blowing nozzle 9 may blow a gas such as water vapor or carbon dioxide gas having the capacity of absorbing radiation into the chamber C and within the space between the steel material pieces 1 and the wall 6. The effect is the same as if heat insulating material is inserted between the steel members 1 and the cooling wall 6, and the cooling speed is thereby controlled.

Although the size of the gas layer is generally constant based on the restriction of the construction of the apparatus, the gas partial pressure may be controlled to be from 0% (when a gas such as air having no capacity of absorbing radiation fills that space) to a gas partial pressure of 100%. When the control of the cooling speed is not necessary, the cooling of the solid material of high temperature may be achieved through a simple device of the pressure setting is made constant in terms of vapor separator 4 and gas injection through nozzles 9 are not employed.

Thus, in accordance with the present invention, the cooling speed of the solid of high temperature such as high carbon steel members may be controlled over a wide range by varying the combination of the cooling wall temperature and the gas partial pressure of a gas filling the space between the steel members 1 and the heat absorbing wall 6. Further, since the thermal energy inherent in the solid of high temperature may be recovered, the apparatus may advantageously serve as a water vapor generator.

What is claimed is:

1. An apparatus for cooling a high temperature solid, comprising:

wall means enclosing a high temperature solid in spaced relationship thereto to be heated substantially by radiation of the heat from said solid, said wall means including means for circulating a liquid coolant therethrough, a coolant inlet and a coolant outlet;

pump means for feeding said liquid coolant into said circulating means through said inlet;

separator means for separating said coolant into liquid and gaseous phases;

first conduit means connecting said coolant outlet of said circulating means to said separator means;

second conduit means connecting said separator means to said pump means;

pressure control means connected to said separator means for varying the gas pressure therein to change the saturation temperature in said separator means to thereby control the liquid coolant temperature and consequently the cooling speed of said solid; and means for filling the space between the solid and the wall with a gas capable of absorbing the heat of radiation from said solid and to thus control the cooling speed of said solid.

2. The apparatus as claimed in claim 1, wherein said gas comprises water vapor.

3. The apparatus as claimed in claim 2, wherein said gas comprises carbon dioxide gas.

4. The apparatus as claimed in claim 1, wherein said means for filling said space with gas comprises at least one blower opening up into said space, and being fluid coupled to a source of said gas.

5. The apparatus as defined in claim 1 wherein said pressure control means comprises:

sensor means connected to said separator means for sensing the gas pressure therein;

third conduit means connected to said separator means for permitting escape of the gas pressure therefrom; and valve means provided in said third conduit means and responsive to said sensor means for opening and closing said third conduit means.

6. The apparatus as defined in claim 1 further comprising:

means for transporting said high temperature solid to a position within said wall means and for supporting said solid during cooling.

* * * * *